US008434737B2

(12) United States Patent
Zhou

(10) Patent No.: US 8,434,737 B2
(45) Date of Patent: May 7, 2013

(54) CRANE WITH A FREELY POSITIONABLE OIL PUMP HANDLE

(76) Inventor: Haoliang Zhou, Zhejiang (CN)

( * ) Notice: Subject to any disclaimer, the term of this patent is extended or adjusted under 35 U.S.C. 154(b) by 384 days.

(21) Appl. No.: 12/939,183

(22) Filed: Nov. 4, 2010

(65) Prior Publication Data

US 2012/0112146 A1 May 10, 2012

(51) Int. Cl.
*B66C 23/48* (2006.01)

(52) U.S. Cl.
USPC ..... 254/8 B; 254/2 B; 254/8 R; 269/17

(58) Field of Classification Search ..... 254/8 B, 254/2 B, 8 R, 120, 134, 9 B; 269/17
See application file for complete search history.

(56) References Cited

U.S. PATENT DOCUMENTS

| | | | | | |
|---|---|---|---|---|---|
| 3,750,254 | A * | 8/1973 | Krajcik | ..... | 254/93 R |
| 3,780,987 | A * | 12/1973 | Craft et al. | ..... | 254/8 R |
| 3,836,027 | A * | 9/1974 | Gardner | ..... | 414/427 |
| 4,771,531 | A * | 9/1988 | Asher | ..... | 29/426.3 |
| 5,181,821 | A * | 1/1993 | King, Sr. | ..... | 414/427 |
| 5,505,578 | A * | 4/1996 | Fuller | ..... | 414/427 |
| 6,505,815 | B1 * | 1/2003 | Dellamore | ..... | 254/2 B |
| 2012/0112146 | A1 * | 5/2012 | Zhou | ..... | 254/8 B |

* cited by examiner

*Primary Examiner* — Lee D Wilson

(57) ABSTRACT

A crane with a freely positionable oil pump handle: the present invention relates to an easily operated crane with a freely positionable oil pump handle which significantly enlarges the working area of the operators and considerably broadens the application area of the crane, thereby widening the market prospects.

4 Claims, 2 Drawing Sheets

CRANE WITH A FREELY POSITIONABLE OIL PUMP HANDLE

BACKGROUND OF THE INVENTION

The present invention relates to a lifting machine and more particularly pertains to an easily operated crane.

A conventional crane comprises a base, a post, a boom and an oil cylinder. The base has a bottom side with is disposed with freely movable rollers. The post is vertically disposed on the base. The boom is pivotally mounted to a top end of the post and is provided with a hook at a front end thereof for hanging a heavy load. The oil cylinder functioning as actuating mechanism has a cylinder body pivotally mounted to the post and a piston rod extending upward. The piston rod has a top end which is pivotally mounted to the boom. During operation, the operator manually pulls the handle of the oil pump up and down to deliver hydraulic oil, and the hydraulic oil drives the piston rod in the oil cylinder to move upwards to press against the boom. The boom is then driven to rotate anti-clockwise around the pivotal point, thereby lifting the heavy load hung on the hook.

The disadvantage of this kind of crane is that the operation position of the oil pump handle is relatively fixed. This restricts the activity of the operators to a certain fixed position. As a result, the crane fails to adapt to various kinds of working environments and is therefore limited in application areas.

BRIEF SUMMARY OF THE INVENTION

To overcome the aforesaid disadvantages in the prior art, the present invention provides an improved crane which is easy to operate, simple in structure and safer in performance.

To attain this, the present invention provides a crane with a freely positionable oil pump handle which comprises a base disposed with rollers at a bottom side thereof, a post vertically disposed on the base, a boom pivotally mounted to a top end of the post and provided with a hook, and an oil cylinder functioning as actuating mechanism which has a cylinder body pivotally mounted to the post and a piston rod having a top end pivotally mounted to the boom; the cylinder body has a bottom portion which is fixedly disposed at one side thereof with an oil pump with a handle; characterized in that a pivotal connection means between the cylinder body and the post comprises a supporting sleeve having a bottom end which is pivotally mounted to the post and a top end which is provided with a positioning opening; and a rotatable movable head disposed at a bottom end of the cylinder body which inserts into the positioning opening; and the movable head has a rotation axis which is co-axial with the cylinder body.

A positioning pin protrudes downward from the bottom end of the cylinder body at a position adjacent to the movable head, and the supporting sleeve is disposed with a recess which corresponds to the positioning pin at an end surface thereof facing the cylinder body.

The recess forms an incomplete circle which extends around circumference of the movable head.

The movable head is connected to the supporting sleeve via bearings.

The advantages of the present invention are as follows: As the cylinder body of the oil cylinder of the crane and the handle can axially rotate around the cylinder body, operators can grasp the handle to operate at most of the areas around the cylinder body. This significantly enlarges the working area of the operators and considerably broadens the application area of the crane, thereby widening the market prospects. Further, the positioning pin confines the rotational area of the handle (so that the handle will not collide with the post) and therefore effectively guarantees the safety of use.

DETAILED DESCRIPTION OF THE INVENTION

Figure 1:
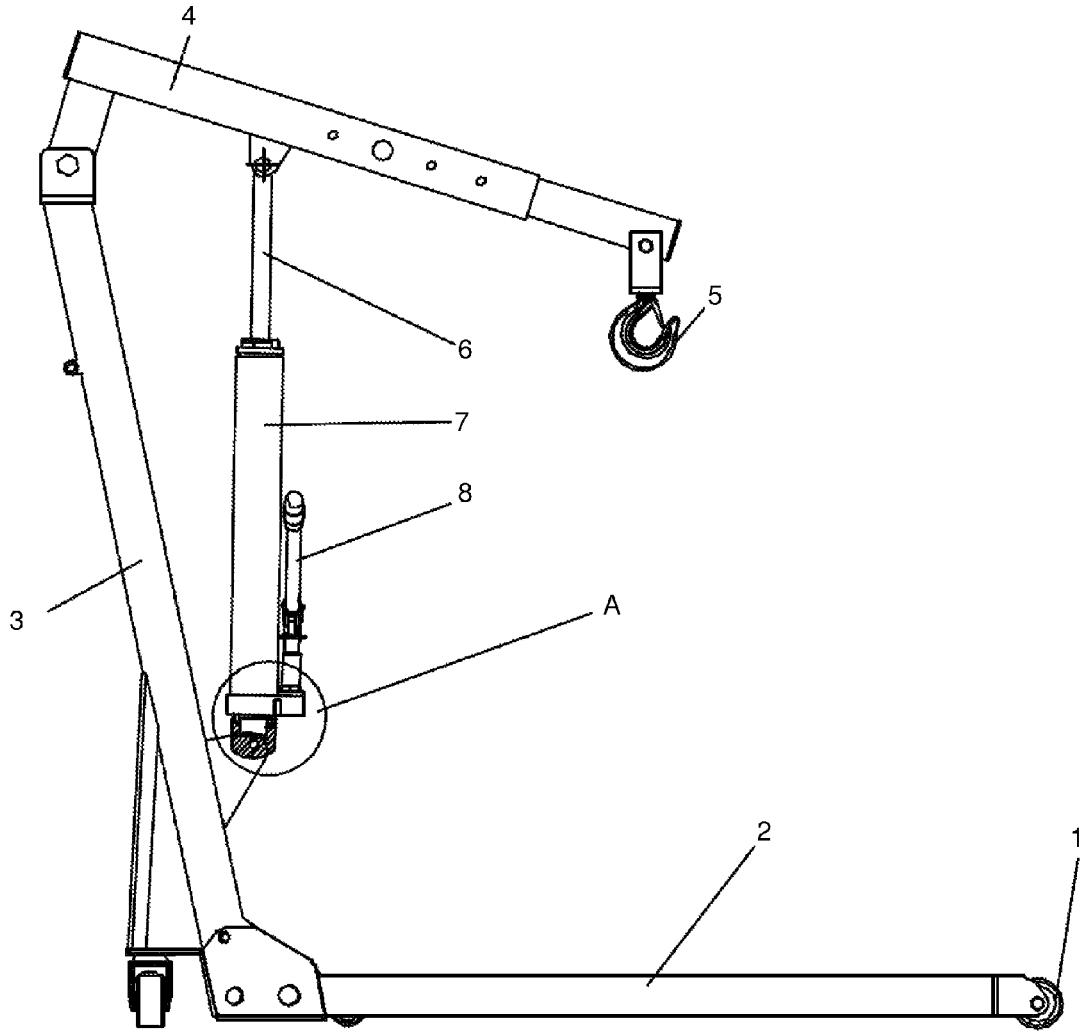
FIG. 1 is a perspective view of the present invention.
Figure 2:
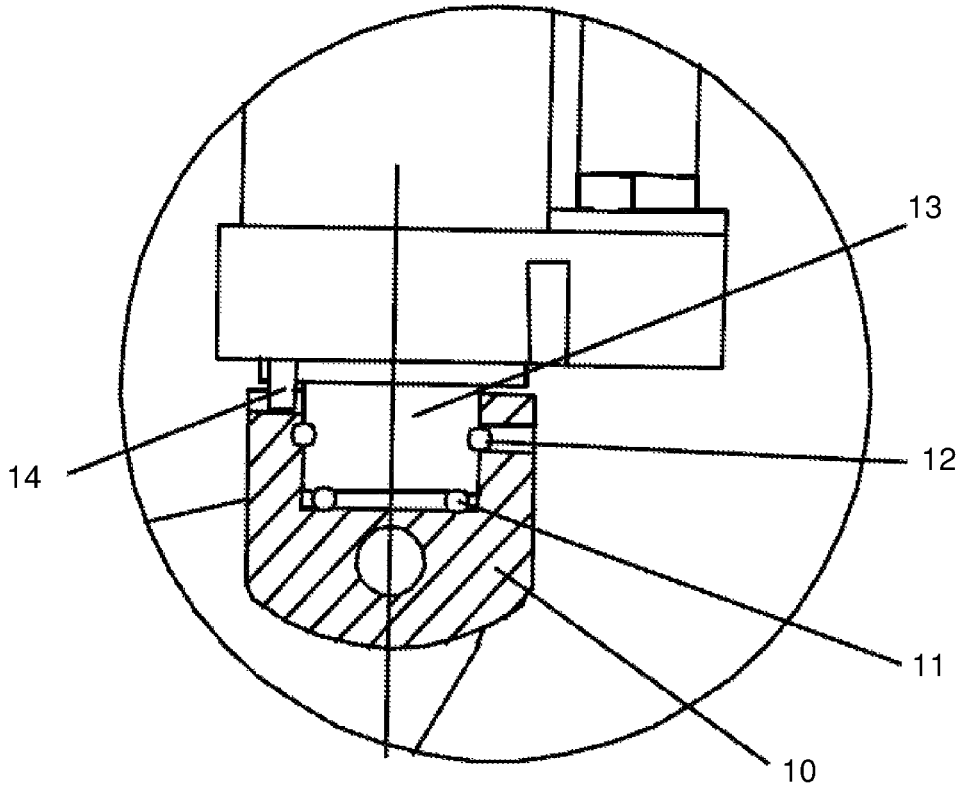
FIG. 2 is an enlarged view of the portion marked "A" in FIG. 1.

As illustrated, the crane with a freely positionable oil pump handle comprises a base 2 disposed with rollers 1 at a bottom side thereof, a post 3 vertically disposed on the base, a boom 4 pivotally mounted to a top end of the post and provided with a hook 5, and an oil cylinder functioning as actuating mechanism. The oil cylinder has a cylinder body 7 which is pivotally mounted to the post and a piston rod 6 which has a top end pivotally mounted to the boom. The cylinder body has a bottom portion which is fixedly disposed at one side thereof with an oil pump with a handle 8. The above structure is the same as present cranes.

The improvement of the present invention is as follows: A supporting sleeve 10 is added between the cylinder body and the post. The supporting sleeve has a bottom end which is pivotally mounted to the post and a top end which is provided with a positioning opening. The cylinder body has a rotatable movable head 13 at a bottom end thereof which inserts into the positioning opening. The movable head has a rotation axis which is co-axial with the cylinder body. By means of the above, the cylinder body of the oil cylinder rotates axially around the cylinder body.

A positioning pin 14 protrudes downward from the bottom end of the cylinder body at a position adjacent to the movable head. The supporting sleeve is disposed with a recess which corresponds to the positioning pin at an end surface thereof facing the cylinder body. The recess forms an incomplete circle which extends around circumference of the movable head (the recess forms a major portion of a circle at the end surface of the supporting sleeve facing the cylinder body). In this way, when the cylinder body of the oil cylinder rotates axially, it could only rotates for a major portion of a circle, thereby preventing the handle from colliding with the post and thus eliminating unsafe factor.

The movable head is connected to the supporting sleeve via bearings. As illustrated from the figures, a flat bearing 11 is disposed between an end surface of the movable head and a bottom of the positioning opening, and a positioning bearing 12 is disposed between a circumferential surface of the movable head and side walls of the positioning opening, thereby enhancing the connection strength of the movable head and the positioning opening.

What is claimed is:

1. A crane with a freely positionable oil pump handle which comprises a base (2) disposed with rollers (1) at a bottom side thereof, a post (3) vertically disposed on the base, a boom (4) pivotally mounted to a top end of the post and provided with a hook (5), and an oil cylinder functioning as actuating mechanism which has a cylinder body (7) pivotally mounted to the post and a piston rod (6) having a top end pivotally mounted to the boom; the cylinder body has a bottom portion which is fixedly disposed at one side thereof with an oil pump with a handle (8); characterized in that a pivotal connection means between the cylinder body and the post comprises a supporting sleeve (10) having a bottom end which is pivotally mounted to the post (3) and a top end which is provided with a positioning opening; and a rotatable movable head (13) disposed at a bottom end of the cylinder body which inserts into the positioning opening; and the movable head has a rotation axis which is co-axial with the cylinder body.

2. The crane with a freely positionable oil pump handle as in claim 1, characterized in that a positioning pin (14) protrudes downward from the bottom end of the cylinder body at a position adjacent to the movable head, and the supporting sleeve is disposed with a recess which corresponds to the positioning pin at an end surface thereof facing the cylinder body.

3. The crane with a freely positionable oil pump handle as in claim 1 or 2, characterized in that the recess forms an incomplete circle which extends around circumference of the movable head.

4. The crane with a freely positionable oil pump handle as in claim 3, characterized in that the movable head (13) is connected to the supporting sleeve (10) via bearings.

* * * * *